United States Patent [19]

Hummel et al.

[11] Patent Number: 4,711,175

[45] Date of Patent: Dec. 8, 1987

[54] INK DISPENSING MEANS FOR PRINTING PRESSES

[75] Inventors: Peter Hummel, Offenbach am Main; Joachim Steuer, Offenbach, both of Fed. Rep. of Germany

[73] Assignee: M.A.N.-Roland Druckmaschinen Aktiengesellschaft, Fed. Rep. of Germany

[21] Appl. No.: 826,143

[22] Filed: Feb. 4, 1986

[30] Foreign Application Priority Data

Feb. 4, 1985 [DE] Fed. Rep. of Germany ..... 3503736

[51] Int. Cl.[4] ..... B41F 31/04

[52] U.S. Cl. ..... 101/365

[58] Field of Search ..... 101/365, 350, 207, 208, 101/209-210

[56] References Cited

U.S. PATENT DOCUMENTS 3,978,788 9/1976 Cappel et al. ..... 101/363

4,534,290 8/1985 Schroder et al. ..... 101/365

*Primary Examiner*—J. Reed Fisher

*Attorney, Agent, or Firm*—Leydig, Voit & Mayer

[57] ABSTRACT

An inking unit disposed in the ink duct of a printing press includes dispensing elements for regulating the quantity of ink dispensed on the duct roller of the press and includes a plurality of blades disposed on linear adjusters for movement in the plane passing through the longitudinal axis B of the quantity-regulating dispensing elements and the line of contact between the dispensing edge thereof and the duct roller. Each blade is secured to a retaining pin on the adjuster by way of a securing aperture disposed perpendicularly to its bearing surface, and only minimal clearance, which can be very reduced in the direction of movement, is left between the pin and the securing aperture, so that when the ink gap closes, the blade of a dispensing element can automatically be aligned parallel by the dispensing edge bearing on the surface of the duct roller.

13 Claims, 9 Drawing Figures

INK DISPENSING MEANS FOR PRINTING PRESSES

FIELD OF THE INVENTION

The present invention relates generally to printing presses and more particularly concerns an ink dispensing unit for regulating the quantity of ink supplied from an ink duct to the duct roller of a printing press.

BACKGROUND OF THE INVENTION

Inking units for regulating the quantity of ink dispensed on a duct roller from the ink duct of a printing press are known to include zone dispensing elements which are adjustable relative to the duct roller and which have a dispensing edge cooperating with the duct roller to define a dispensing gap with the edge movable relative to the duct roller substantially radially and with the dispensing edge being disposed on a blade releasably retained on an adjuster. German patent No. 3 0303 774 discloses an inking unit of this kind.

Such inking units are used in printing presses, more particularly offset presses, to ensure accurate and reproducible adjustment of ink quantity. Therefore, it is necessary to adjust the quantity of ink to different extents widthwise of the press and in zonally independent manner. The difficult part of this problem is the need for extremely accurate alignment of the various dispensing elements for very reduced ink layer thicknesses. The necessary outlay and the risk of the dispensing edge of the various dispensing elements being damaged should not be underestimated. If discrete dispensing elements or the blades on their adjusters are aligned inaccurately, what are known as "edge carriers" may arise which make it impossible to find an accurate zero setting for the particular dispensing elements concerned. Since in such cases the printer endeavors to engage the dispensing element completely with the duct roller by further adjustment in the particular zone concerned, damage easily arises because of increased wear. Nevertheless, it is an important objective to ensure accurate adjustment.

According to the above-mentioned German patent No. 3 030 774, the dispensing edge is disposed on a push-shoe having spring steel plates or the like, on discrete ink-dispensing elements in the form of adjusters. The plates, with their hard resilient substance, form the dispensing edge and are secured in a resilient embedding composition. Also, the composition is formed with a recess behind the dispensing edge. This dispensing element reduces the wear to some extent because of the increased strength of the dispensing edge and because of the resilience thereof. Ease of service is improved by simple replacement of the shoe which can also latch in the ink-dispensing element by way of cast-on protuberances.

The alignment of the shoe relatively to the adjuster is not variable in the ink dispensing element just described—i.e., the dispensing edge cannot be adjusted independently relative to the adjuster. Errors of manufacture are therefore fully transferred to the assembled unit and affect the accuracy of ink dispensing. In all, the ink-dispensing element suffers less from wear but does not ensure that the adjustment of the thicknesses of thin ink films is always accurate. Consequently, accurate alignment and equalization of the dispensing edge of the various dispensing elements relative to one another causes problems just as severe as adjustments relative to the duct roller.

For example, if a slightly inclined ink-dispensing element was to be operated at zero ink film thickness, the dispensing edge would have to bend in order to interrupt the supply of ink completely. This bending is possible but sets a wrong zero for the opening of the dispensing gap, for when the ink-dispensing element returns, such gap is initially opened only on one side, with the result of underinking. Also, the power consumption relative to the duct roller is such that it bends by something like 10 times the permissible gap for minimum inking between the dispensing edge and the roll surface. Consequently, independent widthwise adjustment of the dispensing elements cannot be ensured.

OBJECTS AND SUMMARY OF THE INVENTION

It is therefore the primary object of the present invention to provide means for regulating the quantity of ink dispensed on a duct roller such that the outlay needed to align the ink-dispensing elements relative to the duct roller and the force applied by the dispensing element to such roller is reduced decisively with minimum ink guidance, the dispensing edge being adapted to be aligned readily and totally on the duct roller surface.

In carrying out the present invention there is provided an inking unit disposed in the ink duct of a printing press for regulating the quantity of ink dispensed on the duct roller of the press including a plurality of zone dispensing elements adjustably mounted relative to the duct roller and which have a dispensing edge cooperating with the duct roller to define a dispensing gap, with the dispensing elements being movable relative to the duct roller substantially radially, the dispensing edge being disposed on a blade releasably retained on an adjuster, and characterized in that the blade is immobile and is mounted on the dispensing element for movement in a plane determined by the direction of dispensing element movement and by the duct roller generatrix contacted by the dispensing edge. Preferably, the blade is mounted with clearance around a fulcrum disposed perpendicular to the longitudinal axis (B) of the dispensing element and at least one surface on which the blade bears is so disposed at a place within its retaining means that the blade fulcrum (C) has limited provision for displacement.

The inherently rigid construction of the blade ensures that the position of the dispensing edge relative to the drive of the dispensing elements is always accurate. Since the blade can rotate on the dispensing element, merely moving the blade towards the duct roller is sufficient to align the dispensing edge relatively to the duct roller surface. There is no need for manual fine adjustment. It has been found that if the blade is in the form of a rockable element, hydrodynamic effects deriving from the ink do not impair the alignment of the dispensing edge. The blade is adjusted to an equilibrium of forces arising from the pressure in the ink drawn through the ink gap. In the arrangement described, the center of the dispensing edge is always at the correct distance from the duct roller while the corners of the dispensing edge are at the same distance from or at appropriately different distances from the duct roller surface. However, the opening available for ink conveyance always has the same area —i.e., the quantity of ink conveyed through the gap over the width of a zone is always the same. Theoretically, the dispensing edge can become skewed only because of manufacturing inaccuracies in the region of the blade mounting; however, because of the flexibility feature this consideration is virtually negligible. Inaccuracies are very reduced and are virtually ineffective so far as ink distribution is concerned, since because the distribution is effected transversely of the inking unit, the layer or film differences still present on the duct roller within any single inking zone are smoothed out again substantially completely.

One very important effect of the means disclosed is that even though the ink-dispensing elements of this kind become skewed relatively to the duct roller surface, no "edge carriers" can arise. When the dispensing elements move in—i.e., when the ink gap closes—the projecting corner of the blade bears on the duct roller surface, whereafter because of its rotatable mounting the blade aligns itself until the dispensing edge is in complete engagement with the duct roller surface.

As a rule, no particularly great accuracy is required for the mounting of the blades on the dispensing elements, since all that is necessary is to provide for the blade to have a bearing or support surface enabling the blade to align itself around a pivot or fulcrum. Since the blade can therefore be arranged relatively loosely, the blade is readily interchangeable. Indeed, the blade can be replaced in the ink duct without any need to dismantle the dispensing element therefrom. Very substantial advantages are therefore provided as regards the cost of assembly and fitting and more particularly the accuracy of adjustment of the ink-dispensing elements.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
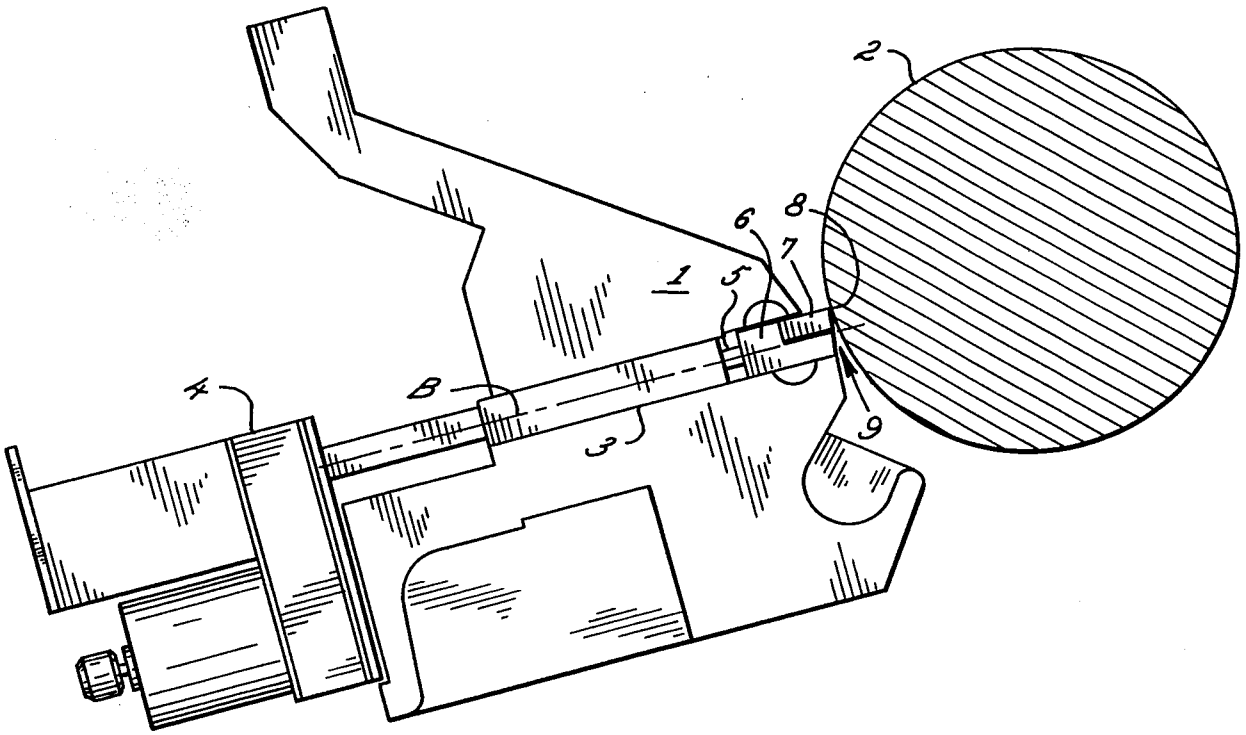
FIG. 1 is a general view of an ink duct including an ink dispensing unit according to the present invention.

Turning now to the drawings, FIG. 1 shows the basic relationship of the ink dispensing unit of the present invention in association with an ink duct 1 and an ink duct roller 2. A quantity-regulating element 3, hereinafter called a dispensing element, is secured with its drive 4 in the ink duct 1. The drive 4 is directly coupled by a spindle 5 to an adjuster 6 movable radially or substantially radially relative to the roller 2. A blade 7 is disposed on the adjuster 6. Movement of the adjuster 6 moves a dispensing edge 8 at the front of the blade 7 relative to the roller 2 so that an inking gap 9 is defined between the duct roller surface and the edge 8.

Figure 2:
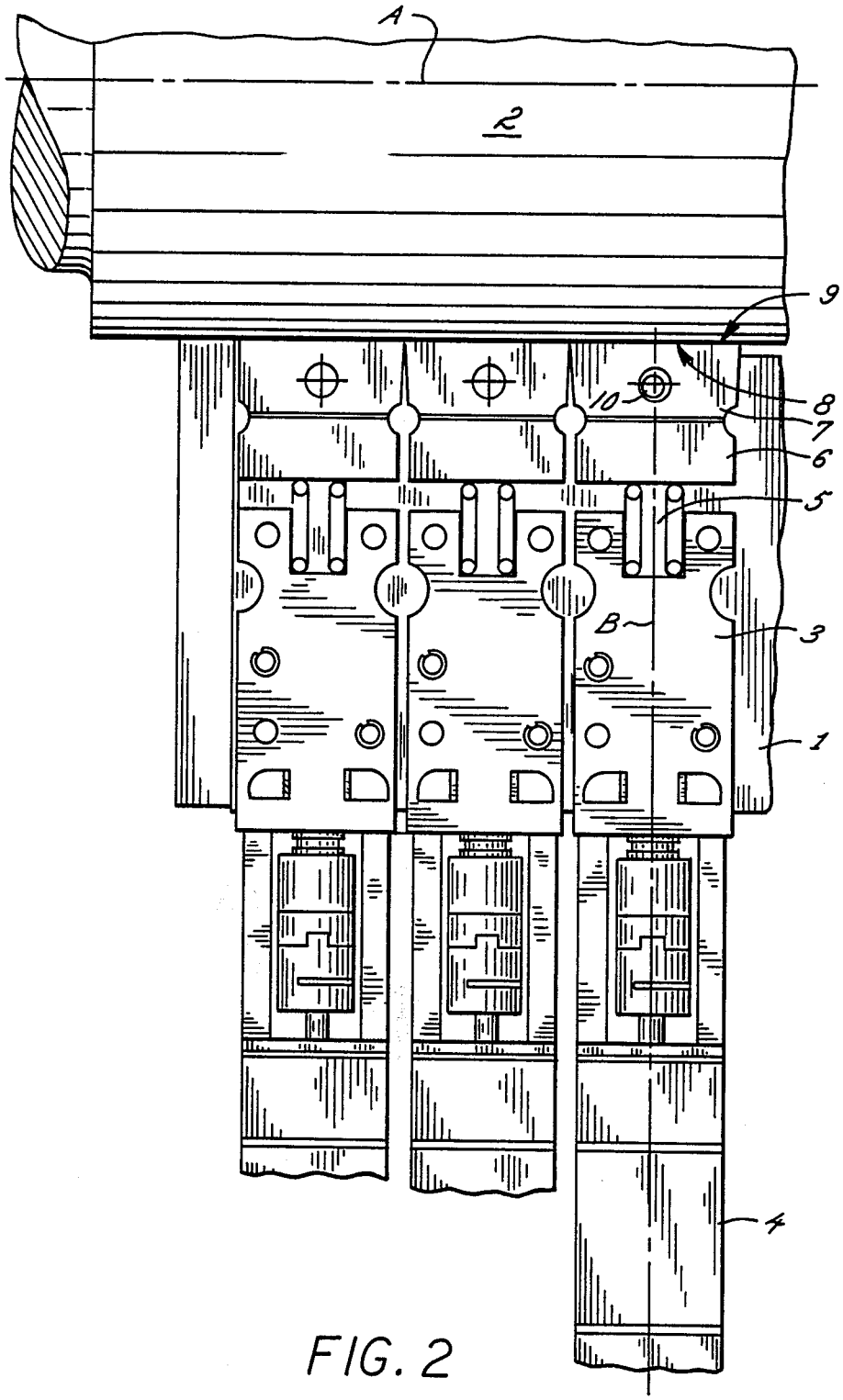
FIG. 2 is a fragmentary plan view showing the relationship of dispensing elements on the ink duct roller.

FIG. 2 shows in plan view the relationship of the dispensing elements 3 generally perpendicular to the axis A of the roller 2. The elements 3 with their drives 4 are disposed one beside another on the duct 1, the longitudinal axes B of the elements 3 being disposed substantially parallel to one another, and the relationship is such that the blades 7 touch one another. Preferably, the adjusters 6 are narrower and do not touch one another. Securing screws are provided to determine the alignment of the elements 3. The screws are engaged in tapped apertures and retain the elements on the bottom of the ink duct 1.

When the elements 3 are aligned relative to the surface of the roller 2, the screw-threaded connection between the elements 3 and the ink duct 1 is an important factor. As the retaining screws just referred to are finally tightened, the elements 3 experience a torque which affects their alignment. Consequently, it is a very elaborate business to adjust the longitudinal axis B of the elements 3 accurately perpendicularly to the duct roller axis A. If the dispensing edge 8 had to be adjusted by way of alignment of the elements 3, the assembly and subsequent replacement of the discrete elements 3 would be very difficult. According to the invention therefore, and as will be described hereinafter, the blade 7 is removably secured to the adjuster 6 in a non-rigid manner.

Figure 3:
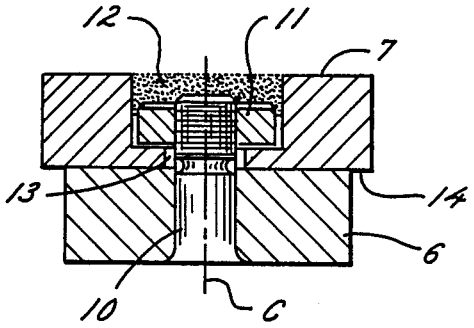
FIG. 3 is an enlarged cross-section through the mounting or securing of a blade on an adjuster element.

The securing of the blades is basically the same in all the embodiments described and is shown just once in the enlarged cross-section of FIG. 3. A retaining pin 10 is riveted or otherwise secured in the adjuster 6 so as to be perpendicular to the major dimension thereof. The pin 10 has screw-threading and a nut 11 retains the blade 7 on the pin 10 and prevents the blade 7 from tilting. For improved assembly the nut 11 is preferably formed with a transverse slot; it can then be screwed into a recess 12 formed at its base with an opening 13 for guiding the blade 7. The recess 12 and opening 13 are perpendicular to the bearing surface 14.

The shape of the opening 13 and its dimensions relative to the pin 10 will be described in detail hereinafter since they are the main elements determining the movement pattern of the blade 7. An insert such as a cup spring can be provided between the nut 11 and the blade 7 to obviate clearance in the position of the blade 7 and to compensate for manufacturing inaccuracies. However, the nut 11 can be placed on the pin 10 without any insert so tightly over the blade 7, then secured, for example, by sticking, as to secure the blade 7 directly. Consequently, the blade 7 can then move freely on its bearing surface 14 but cannot tilt from its full-surface engagement with the adjuster 6. After assembly the recess 12 is filled with a potting compound and protected against the entry of ink. In the discussion that follows, a description will be given of how, by displacement of the rotational axis C of the blade 7, different variants are possible for the cross-sectional shape of the blade 7 in its major dimension and of the shape of the apertures 13.

Figure 4:
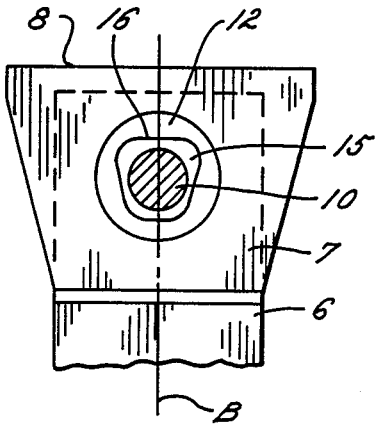
FIGS. 4–8 are plan views of variants of the blade mounting.

As a basic starting point, it may be assumed that the blade 7 is to be aligned on the surface of the roller 2 only when it is required to close the gap 9. The clearance in the mounting is to be used in the opening of the gap 9 by the blade 7 in this case oscillating like a balance beam relative to the adjuster 6 as a result of being acted on by the hydrodynamic pressure of the ink. The flow cross-section of the gap 9 always corresponds to the necessary opening cross-section for a particular quantity of ink, since the main parameter for ink quantity is the position of the adjuster 6 or of its aligning surface. A very simple variant on this point is shown in FIG. 4.

The opening 13 is in the form of a simple aperture 15 having relatively considerable clearance relative to the pin 10. The aperture 15 can widen forwardly so that a plane bearing surface 16 is formed. The blade 7, when aligned on the roller 2 by the pressure of the ink, normally bears on the surface 16; however, it can deviate in all directions since the rotational axis is disposed behind the edge 8.

Figure 5:
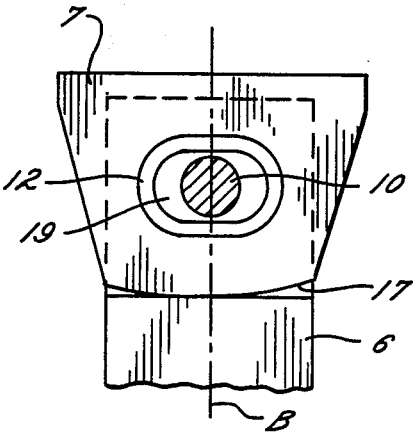

FIG. 5 shows another embodiment wherein the rotational axis C has been displaced to the rear edge of the blade 7. Accordingly, the blade 7 has a convex rear surface 17 disposed opposite the edge 8. The blade 7 is adapted to bear by way of the surface 17 on a rectilinear bearing surface 18 of the adjuster 6. A retaining pin 10 is disposed therein to retain the blade 7 on the adjuster 6. Also, the blade 7 is formed with a slot 19 through which the pin 10 extends. The blade 7 may be secured to the adjuster 6 in the manner discussed above (see FIG. 3). This embodiment can also be altered in various ways. For instance, the convex surface can be on the adjuster 6 instead of on the blade 7, in which event the rear surface 17 thereof is a plane surface. Similarly, the blade 7 can bear by way of a plane rear surface 17 on a cylindrical pin in the adjuster 6.

In addition, the clearance in the mounting of this embodiment can be reduced very considerably. This leads to some complication of the construction of the dispensing elements 3 since they must be made to higher standards of accuracy, but it may be very important that the blades 7 can in this case be mounted without longitudinal clearance. A second underlying idea starts from the fact that the blades 7 must always be guided accurately in the longitudinal direction but that they should be able to adjust their alignment relative to the longitudinal axis B as regards their angular position and their position transversely of the axis B. Once this adjustment has been made, their alignment should be retained as far as possible and in any case at least until the next adjustment.

Figure 6:
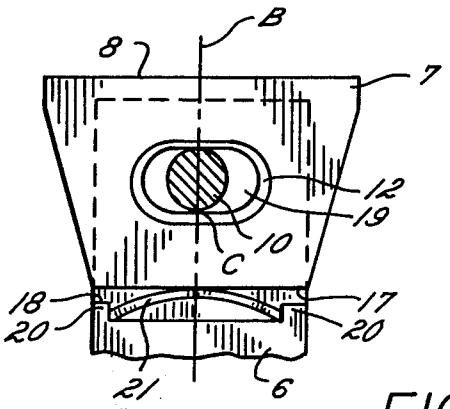

An example will now be described with reference to the embodiment which is shown in FIG. 6 and which represents a position between the two underlying ideas set out in the foregoing. Referring to FIG. 6, the blade 7 is formed with a slot 19 as its securing aperture. Its rear surface 17 is rectilinear and does not contact the adjuster 6. The adjuster is formed near its bearing surface 18 with a recess such that a retaining protuberance 20 remains at each outer edge of the surface 18. Preferably, a spring strip 21 is clamped between the protuberances 20 and the convexity of the spring strip 21 acts on the blade rear surface 17 so that, by way of the rear boundary surface of the slot 19, the blade 17 is biased towards the pin 10. The blade 7 is in this way devoid of longitudinal clearance but can make rotating and sliding movements. In any case, when the gap 9 is open the spring strip 21 restores the blade 7 to a neutral normal position. The normal position depends, in respect of its alignment relative to the axis B of the elements 3, upon the manufacturing accuracy of the arrangement, more particularly upon the centering of the spring strip 21 relative to the pin 10.

Figure 7:
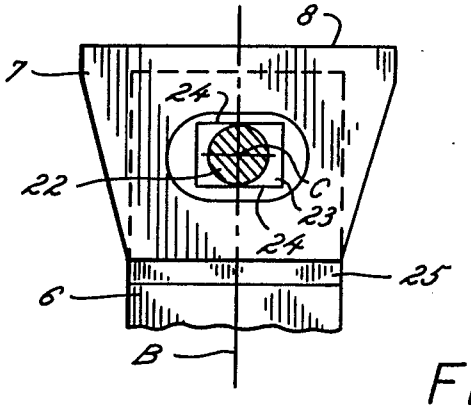
Figure 9:
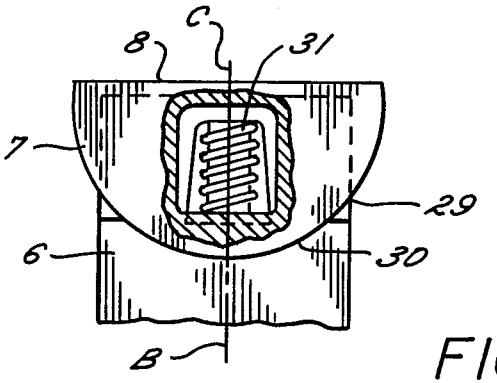
FIG. 9 is an enlarged fragmentary plan view showing a detail of the external shape of a pair of adjacent blades.

FIG. 7 shows another embodiment of a blade 7 which is movable on the adjuster 6 and which with present day knowledge can be regarded as the most advantageous construction economically, design-wise and process-wise. The particular point embodied in this case is that clearance in the mounting in the direction of movement of the adjuster 6 is minimized but clearance transversely to the direction of movement is adapted to circumstances for positional compensation. Accordingly, a guide pin 22 is disposed on the adjuster 6. The pin 22 has a closely toleranced surface. The blade 7 is formed with a guide slot 23 having the following dimensions: parallel to the edge 8 it is approximately 1 mm larger than required for the diameter of the pin 22; the width of the slot 23 in the direction of the axis B is equal to the diameter of the pin 22. The slot surfaces which are parallel to the edge 8 are plane guide surfaces 24 and must be substantially parallel. It will be understood, of course that the blade 7 must be placable relatively readily on the pin 22 and must remain mobile thereon. Clearance 25 for movement relative to the adjuster 6 is therefore also necessary at the rear. Retention can be merely the kind of securing shown in FIG. 3. When the adjuster 6 moves, the blade 7 always follows the "instructions" of the drive 4, but the blade 7 is mobile relative to the adjuster 6 and, therefore, to the element 3.

Figure 8:
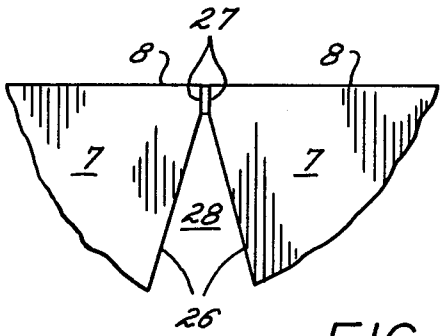

In all the various embodiments, the blade 7 must be treated in the zones near the edge 8 for adaption of the side edges of the blades 7 to one another. The cross-sectional shape of FIG. 8 is illustrated in the form in which it appears when two blades 7 contact one another. Preferably, the blade side edges 26 taper conically to the rear. Ideally, a cylindrical sealing surface 27 should be provided on a short portion of the side edges 26 near the dispensing edge 8 to ensure optimum mobility and sealing-tightness. In practice, however, these sealing surfaces 27 are lapped plane over a length of approximately 2 mm and given a low-friction coating.

The overall space is determined by the blades 7 disposed laterally of the particular blade 7 under consideration. Consequently, the rear corners of the blades 7 must be able to move laterally in addition to the blade 7 being rotatable, since as it rotates the blade 7 bears on the surface 27. Accordingly, the blade 7 is arranged to be retained with adequate clearance adapted to take up the maximum possible lateral movement of the blade 7, and the width thereof decreases continuously to the rear from the edge 8. A wedge-shaped movement gap 28 is therefore left between any two blades 7.

A general description will be given hereinafter of the operation of the self-adjusting blades 7. When a dispensing element 3 with drive 4 is assembled in an ink duct 1, the alignment relative to the roller 2 must be maintained substantially at right angles. The blades 7 are then brought into lateral engagement with one another. Also, in assembly, as is conventional with elements 3 of this kind, a sealing compound is introduced near the adjusters 6, to prevent the entry of ink into the drive 4 or other parts of the dispensing elements 3.

After assembly each dispensing element 3 can be zero adjusted independently. To this end, the adjuster 6 is moved by the drive 4 towards the roller 2. If the element 3 is not aligned at true right angles to the roller 2 or if the blade 7 is not disposed straight on the adjuster 6, one of the corners of the edge 8 first contacts the roller 2. As previously discussed, in the known version of the rigid adjuster, this contact is known as an "edge carrier". Conventionally, it has not been possible to have accurate zero adjustment of the adjuster in this zone.

In the ink dispensing means according to the present invention, however, the blade 7, being mobile, turns on the adjuster 6 until the edge 8 is in fully flush engagement with the surface of the duct roller 2. Only then has the proper zero adjustment of the element 3 been reached. This adjustment can be retained mechanically or electrically. In a position thus adjusted the supply of ink to a subsequent inking unit is stopped completely for the particular inking zone concerned. The elements 3 can then be adjusted seriatim for the entire ink duct 1.

However, depending on the nature of the blade mounting, various movement patterns may be operative in the alignment on the duct roller surface. In the versions shown in FIGS. 4–7 there is a superimpositioning of movements. Since the fulcrum of the blade 7 is disposed behind the edge 8, a pure rotation at the edge 8 would lead to a cross-movement or cross-displacement. Such cross-displacement must be compensated for by a sliding movement of the complete blade 7. What happens in practice is that because the blade 7 is retained laterally between the adjacent blades 7, the blade 7 does not rotate around the bearing on which it bears momentarily but moves relatively to the mounting thanks to the available clearance. The relative movement, called a sliding movement, means that the blade side edges 26 move relatively to one another. Consequently, the blades 7 must not be pointed at their front corners nor be at true right angles to the edge 8 on their side edges but must be shaped in the manner hereinbefore set out.

In another more theoretical than practical but theoretically ideal variant, the relative movements described disappear. The starting point for this embodiment is that the fulcrum C of the blade 7 is placed in the edge 8. To this end, the entire rear boundary surface of the blade 7 can be an arcuate articulation surface 29. The surface 29 bears in another arcuate bearing surface 30. When the blade 7 turns, the corners of the edge 8 move in an orbit corresponding to the surface 29 around the imaginary fulcrum passing through the edge 8. This ensures that the blades 7 do not move beyond the lateral boundary operative in the normal position. Consequently, a blade 7 of this shape cannot anywhere collide with an adjacent blade 7. However, in response to substantial rotation—very unlikely to arise in practice—that corner of the edge 8 which retreats behind the normal line moves away from the adjacent blade 7, a gap opening between the two blades 7. In extreme conditions, therefore, ink might penetrate between the adjusters 6. This might disturb operations, although there is the seal between the elements 3. On the side on which the corner of the dispensing edge projects beyond the normal line, sealing tightness in respect of the adjacent blade 7 is ensured by the arcuate surface 29. Arcuate surfaces 29, 30 of this kind are difficult to produce for practical use. Accordingly, to ensure a clearance-free mounting, a compression spring 31 must press the blade 7 on to the surface 30.

Absence of clearance can also be ensured by using a counter-bearing surface to the articulation surface of the blade 7. For instance, the blade 7 can be machined from a cylindrical blank having the diameter of ink zone width, a cylindrical mounting or base serving as bearing and the dispensing edge being disposed on a diameter on the end face opposite the mounting.

The invention described can of course be embodied by other variants. For example, the bearing position considered could be shifted to before the dispensing edge. However, this would considerably complicate operating conditions.

We claim as our invention:

1. An inking unit disposed in the ink duct of a printing press for regulating the quantity of ink dispensed on a duct roller of the press comprising in combination, a plurality of zone dispesnsing elements, each having a longitudinal axis and each dispensing element being adjustably mounted for movement along said longitudinal axis substantially radially relative to the duct roller, a blade disposed on each of said zone dispensing elements and each blade defining a dispensing edge cooperating with the duct roller to define a dispensing gap, each of said blades having a mounting surface and being adjustably mounted on said zone dispensing element for movement in a plane determined by the direction of dispensing element movement along said longitudinal axis and by the duct roller generatrix contacted by the dispensing edge, means for defining a fulcrum for said blade disposed perpendicular to said mounting surface of said blade and said longitudinal axis of said zone dispensing element, and means for releasably retaining said blade on said dispensing element for limited swinging movement of said blade about said fulcrum relative to said longitudinal axis so as to maintain said dispensing gap substantially uniform.

2. An inking unit according to claim 1, characterized in that said blade is formed with an aperture perpendicular to its mounting surface, a retaining pin is disposed vertically on said dispensing element, said aperture being larger than the diameter of the retaining pin and having at least a front bearing surface, and a retaining nut for securing the blade on the retaining pin.

3. An inking unit according to claim 1, characterized in that the blade is formed with a slot perpendicular to its mounting surface, the major dimension of the slot extending parallel to the dispensing edge, said dispensing element having a retaining pin disposed perpendicular thereon and having a plane bearing surface thereon disposed on the side of said pin opposite to the dispensing edge, the blade having a smooth convex rear surface on the side opposite the dispensing edge and a retaining nut for securing the blade on the retaining pin, the bearing surface of the dispensing element and the convex rear surface of the blade being in contact with one another.

4. An inking unit according to claim 1, characterized in that the blade is formed with a slot perpendicular to its mounting surface, the slot having at least one rear plane guide surface, a retaining pin disposed vertically on said dispensing element, the slot being larger than the pin diameter at least in the direction parallel to the dispensing edge, the blade being mounted on the retaining pin, and a compression spring disposed between the dispensing element and the rear surface of the blade so that the blade is maintained in permanent engagement with the retaining pin by way of the rear guide surface of the slot.

5. An inking unit according to claim 1, characterized in that the blade is formed with a securing aperture perpendicular to its mounting surface, the seecuring aperture being in the form of a guide slot extending parallel to the dispensing edge, the dimension of the slot parallel to the dispensing edge being greater than the dimension of the slot parallel to the longitudinal axis of the dispensing element, the surfaces of the slot parallel to the dispensing edge being guide surfaces, a vertical guide pin disposed on the dispensing element, the distance between the guide surfaces on the blade corresponding to the diameter of the guide pin so that when assembled on the dispensing element the blade is guided without clearance over the guide pin, and a retaining nut for securing the blade on the guide pin.

6. An inking unit according to claim 5, characterized in that the blade has zonal dispensing edge from which sealing surface extend at right-angles, the sealing surfaces being slightly curved and from 1 to 3 mm long, and the blade has side edges which converge slightly conically towards a rear surface of said blade.

7. An inking unit according to claim 1, characterized in that the blade is mounted for rotation substantially without clearance around said fulcrum and the fulcrum extending through the center of the dispensing edge.

8. An inking unit according to claim 7, characterized in that the blade has a zonal dispensing edge at the front and an arcuate articulation surface of the rear, the center of the arcuate surface being at the center of the dispensing edge, the dispensing element has an arcuate bearing surface, the radii of the articulation surface and of the bearing surface are identical, and means including a compression spring is provided for pressing articulation surface of the blade against the bearing surface of the dispensing element.

9. An inking unit according to claim 1 characterized in that said fulcrum is located substantially along said longitudinal axis.

10. An inking unit according to claim 9 characterized in that said blade has a convex rear edge and said fulcrum is located on the rear edge of said blade.

11. An inking unit according to claim 2 characterized in that said fulcrum is located at the interface between said retaining pin and a surface of said aperture.

12. An inking unit according to claim 2 characterized in that said fulcrum is located substantially at the center of said retaining pin.

13. An inking unit according to claim 9 characterized in that said fulcrum is located substantially at the center of said dispensing edge.

* * * * *